US008957887B2

(12) United States Patent
Kim et al.

(10) Patent No.: US 8,957,887 B2
(45) Date of Patent: Feb. 17, 2015

(54) ELECTROPHORETIC DISPLAY APPARATUS AND METHOD OF DRIVING THE SAME

(75) Inventors: Il-Nam Kim, Yongin (KR); Min-Woo Kim, Yongin (KR); Soo-Min Baek, Yongin (KR); Jae-Kyoung Kim, Yongin (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 634 days.

(21) Appl. No.: 13/200,318

(22) Filed: Sep. 23, 2011

(65) Prior Publication Data

US 2012/0169696 A1 Jul. 5, 2012

(30) Foreign Application Priority Data

Dec. 29, 2010 (KR) ..... 10-2010-0138040

(51) Int. Cl.
*G09G 5/00* (2006.01)
*G09G 3/34* (2006.01)
*G09G 3/20* (2006.01)

(52) U.S. Cl.
CPC ..... *G09G 3/344* (2013.01); *G09G 3/2011* (2013.01); *G09G 2230/00* (2013.01); *G09G 2310/0251* (2013.01); *G09G 2310/061* (2013.01)
USPC ..... 345/211; 345/204; 345/206; 345/208; 345/209; 345/210

(58) Field of Classification Search
CPC ..... G09G 3/344; G09G 3/2011; G09G 2310/0251; G09G 2310/0261; G09G 2230/00
USPC ..... 345/87–107, 204–214; 349/25–37, 84
See application file for complete search history.

(56) References Cited

U.S. PATENT DOCUMENTS

| | | | | |
|---|---|---|---|---|
| 4,715,688 | A * | 12/1987 | Harada et al. | 349/34 |
| 4,922,240 | A * | 5/1990 | Duwaer | 345/100 |
| 5,519,411 | A * | 5/1996 | Okada et al. | 345/89 |
| 7,432,895 | B2 | 10/2008 | Mi | |
| 7,859,527 | B2 * | 12/2010 | Hirota et al. | 345/208 |
| 8,232,960 | B2 * | 7/2012 | Fricke et al. | 345/107 |
| 8,284,156 | B2 * | 10/2012 | Miyamoto | 345/107 |
| 2003/0112231 | A1 * | 6/2003 | Kurumisawa | 345/212 |
| 2006/0007090 | A1 * | 1/2006 | Ben-Shalom et al. | 345/89 |
| 2006/0050050 | A1 * | 3/2006 | Zhou et al. | 345/107 |
| 2006/0170648 | A1 * | 8/2006 | Zhou et al. | 345/107 |
| 2006/0284794 | A1 * | 12/2006 | Johnson et al. | 345/58 |
| 2007/0057906 | A1 * | 3/2007 | Johnson et al. | 345/107 |
| 2007/0120812 | A1 * | 5/2007 | Nagayama | 345/107 |
| 2007/0146275 | A1 * | 6/2007 | Choi | 345/92 |
| 2007/0229443 | A1 * | 10/2007 | Sawada et al. | 345/101 |
| 2008/0018589 | A1 | 1/2008 | Shih | |
| 2008/0136765 | A1 * | 6/2008 | Neugebauer | 345/98 |

(Continued)

FOREIGN PATENT DOCUMENTS

| | | | |
|---|---|---|---|
| EP | 0762377 | A2 | 3/1997 |
| JP | 2008-026851 | A | 2/2008 |

(Continued)

*Primary Examiner* — Prabodh M Dharia
(74) *Attorney, Agent, or Firm* — Lee & Morse, P.C.

(57) ABSTRACT

An electrophoretic display apparatus and a method of driving the same. Gradation display using pulse amplitude modulation (PAM) may be achieved using a gate pulse having a pulse width and a voltage level that are set not to fully charge a parasitic capacitance component of a switching transistor included in each pixel.

16 Claims, 9 Drawing Sheets

(56) References Cited

U.S. PATENT DOCUMENTS

| | | | | |
|---|---|---|---|---|
| 2008/0150887 | A1* | 6/2008 | Kim et al. | 345/107 |
| 2008/0150928 | A1* | 6/2008 | Van Der Hoef et al. | 345/210 |
| 2008/0291223 | A1* | 11/2008 | Yamazaki et al. | 345/690 |
| 2009/0184765 | A1* | 7/2009 | Chaoui | 330/251 |
| 2009/0267969 | A1* | 10/2009 | Sakamoto | 345/690 |
| 2010/0091049 | A1* | 4/2010 | Kim | 345/690 |
| 2010/0149145 | A1* | 6/2010 | Van Woudenberg et al. | 345/207 |
| 2010/0164918 | A1* | 7/2010 | Kondo | 345/206 |
| 2010/0167959 | A1* | 7/2010 | Johnson et al. | 506/39 |
| 2010/0214279 | A1* | 8/2010 | Kim et al. | 345/213 |
| 2010/0245341 | A1* | 9/2010 | Tanaka | 345/214 |
| 2011/0102397 | A1* | 5/2011 | Yamazaki | 345/208 |
| 2011/0134162 | A1* | 6/2011 | Yamazaki | 345/690 |
| 2011/0234557 | A1* | 9/2011 | Yang et al. | 345/207 |
| 2012/0092319 | A1* | 4/2012 | van Veenendaal et al. | 345/211 |
| 2013/0181189 | A1* | 7/2013 | Bertin | 257/29 |

FOREIGN PATENT DOCUMENTS

| | | | |
|---|---|---|---|
| KR | 10 1997-0011946 | A | 3/1997 |
| KR | 10 2004-0082505 | A | 9/2004 |

* cited by examiner

ELECTROPHORETIC DISPLAY APPARATUS AND METHOD OF DRIVING THE SAME

CROSS-REFERENCE TO RELATED PATENT APPLICATION

This application claims the benefit of Korean Patent Application No. 10-2010-0138040, filed on Dec. 29, 2010, in the Korean Intellectual Property Office, the disclosure of which is incorporated herein in its entirety by reference.

BACKGROUND

1. Field

Embodiments relate to electrophoretic display apparatuses, and methods for driving the same.

2. Description of the Related Art

Electrophoretic display apparatuses use electrophoretic cells to display input images. Electrophoretic display apparatuses, which display images using the movement of charge carriers in a magnetic field, are next generation display apparatuses with wide viewing angles, good readability, and low power consumption. The electrophoretic display apparatuses have wide applications in concepts of e-book, e-paper, etc. Thus, electrophoretic display apparatuses are being researched in various fields.

SUMMARY

Embodiments may be directed to a pulse amplitude modulation (PAM) driving for gradation display by an electrophoretic display apparatus.

Embodiments may also be directed to an electrophoretic display apparatus and a method of driving the electrophoretic display apparatus in which PAM driving is performed using a driving unit that outputs a source signal having limited levels.

According to an embodiment, there is a method of driving an electrophoretic display apparatus, the method including: providing a gradation period including a plurality of sub-gradation periods for which a state of electrophoretic cells in a plurality of pixels is changed to express a gradation, wherein the gradation period includes: applying gate pulses to the plurality of pixels, respectively, for the plurality of sub-gradation periods, each of the gate pulses having a pulse width and a first voltage level that are set not to fully charge a parasitic capacitance component of a switching transistor of a corresponding pixel of the plurality of pixels; and applying source signals to the plurality of pixels, respectively, when the gate pulses are applied, each of the source signals having a gradation level or an intermediate level. The applying of the source signals may include adjusting a number of sub-gradation periods for which each source signal having the gradation level is applied, and an electrophoretic cell voltage level of an electrophoretic cell in each of the pixels, to control a gradation at each of the pixels.

The method may further include a reset period of resetting the state of the electrophoretic cells of the plurality of pixels.

The resetting period may include: applying at least one of the gate pulses to each of the pixels for the reset period, the at least one gate pulse having a second pulse width and a second voltage level that is sufficient to charge the parasitic capacitance component of the switching transistor of a corresponding pixel; and applying source signals to the plurality of pixels, respectively, when the gate pulses are applied, each source signal having a reset level.

The first pulse width for the gradation period may be less than that of the at least one gate pulse applied to each of the pixels for the reset period.

The gate pulses applied for the gradation period may have a voltage level that is lower than that of the at least one gate pulse applied to each of the pixels for the reset period.

The method may further include a discharge period of discharging the plurality of pixels after the gradation period.

The method may further include applying a common voltage having a constant level to the plurality of pixels.

The method may further include applying a common voltage to the plurality of pixels, wherein the applying of the common voltage includes: applying a first common voltage level of a same polarity as the gradation voltage for the reset period; and applying a second common voltage level of a different polarity from a gradation voltage for the gradation period.

The method may further include a discharge period of discharging the plurality of pixels after the gradation period, wherein the applying of the common voltage may further include applying the common voltage having a same level as the source signals for the discharge period.

The reset period may include a first sub-reset period, a second sub-reset period, and a third sub-reset period for which gate pulses are applied, wherein, among the source signals, a source signal having a reset level and a common voltage having a third common voltage level of an opposite polarity to the reset level may be applied to each of the plurality of pixels for the first sub-reset period. The source signal having the gradation level and the common voltage having the third common voltage level may be applied to each of the plurality of pixels for the second sub-reset period, and the common voltage having a same level as the source signals that may be applied to each of the plurality of pixels for the third sub-reset period.

According to another embodiment, there is an electrophoretic display apparatus including: a plurality of pixels including an electrophoretic cell; a gate driving unit that supplies gate pulses to the plurality of pixels; and a source driving unit that supplies source signals to the plurality of pixels, wherein a gradation period includes a plurality of sub-gradation periods, the gate driving unit for each of the plurality of sub-gradation periods outputs gate pulses to the plurality of pixels, respectively, each of the gate pulses having a first pulse width and a first voltage level that are set not to fully charge a parasitic capacitance component of a switching transistor of a corresponding pixel, and the source driving unit outputs the source signals to the plurality of pixels, respectively, when the gate pulses are applied, each of the source signals having a gradation level or an intermediate level, thereby adjusting the number of sub-gradation periods for which each of the source signals having the gradation level is applied and adjusting a gradation on the plurality of pixels.

The gate driving unit and the source driving unit may operate for a reset period to reset a state of the electrophoretic cells included in the plurality of pixels.

The gate driving unit may apply at least one of the gate pulses to each of the pixels for the reset period, the at least one gate pulse having a second pulse width and a second voltage level that is set to be sufficient to charge the parasitic capacitance component of the switching transistor of the corresponding pixel, and the source driving unit may apply source signals to the plurality of pixels, respectively, for the reset period when the gate pulses are applied, each source signal having a reset level.

The first pulse width for the gradation period is less than that of the at least one gate pulse output to each of the pixels for the reset period.

The first voltage level for the gradation period is lower than that of the at least one gate pulse output to each of the pixels for the reset period.

The gate driving unit and the source driving unit may operate for a discharge period after the gradation period, wherein the plurality of pixels is discharged for the discharge period.

The electrophoretic display apparatus may further include a common voltage driving unit that generates a common voltage having a constant level to apply the common voltage to the plurality of pixels.

The electrophoretic display apparatus may further include a common voltage driving unit that generates a common voltage to apply the common voltage to the plurality of pixels, the common voltage including a first common voltage level of a same polarity as the gradation level for the reset period and a second common voltage level of an opposite polarity to the gradation level.

The gate driving unit, the source driving unit, and the common voltage driving unit may operate for a discharge period after the gradation period, wherein the plurality of pixels is discharged for the discharge period. The common voltage driving unit may apply the common voltage having a same level as the source signals to the plurality of pixels for the discharge period.

The reset period may include a first sub-reset period, a second sub-reset period, and a third sub-reset period for which gate pulses are applied, wherein, among the source signals, the source driving unit may apply a source signal having a reset level to the plurality of pixels for the first sub-reset period, a source signal having the gradation level to the plurality of pixels for the second sub-reset period, and a source signal having the intermediate level to the plurality of pixels for the third sub-reset period. The common voltage driving unit may apply a common voltage having a third common voltage level of an opposite polarity to the reset level to the plurality of pixels for the first sub-reset period and the second sub-reset period, and the common voltage having a same level as the source signal to the plurality of pixels for the third sub-reset period.

BRIEF DESCRIPTION OF THE DRAWINGS

The above and other features and advantages of present embodiments will become more apparent by describing in detail exemplary embodiments thereof with reference to the attached drawings in which.

DETAILED DESCRIPTION

Example embodiments will now be described more fully hereinafter with reference to the accompanying drawings; however, they may be embodied in different forms and should not be construed as limited to the embodiments set forth herein.

Figure 1:
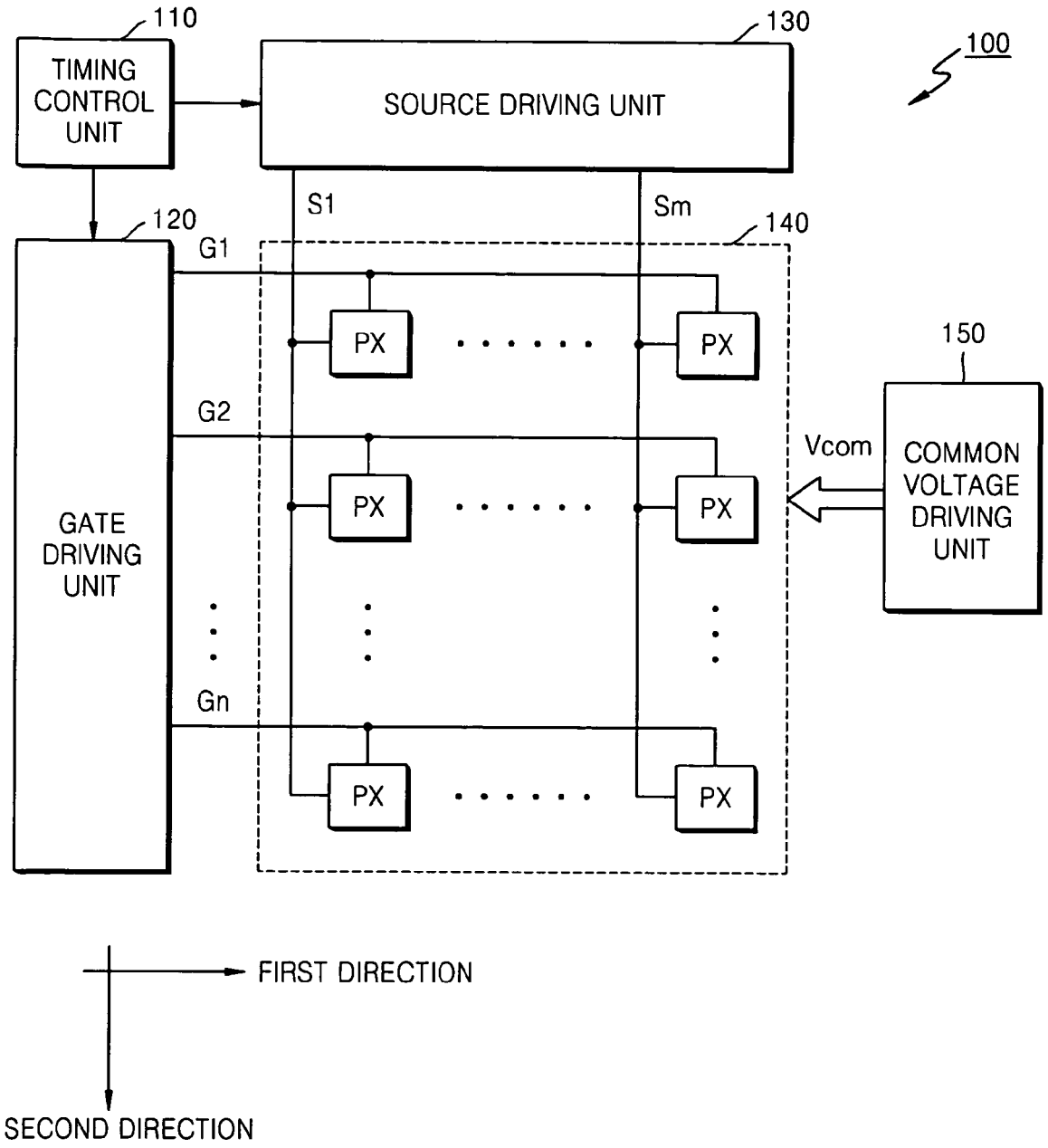
FIG. 1 is a schematic block diagram of an electrophoretic display apparatus according to an exemplary embodiment.

FIG. 1 is a schematic block diagram of an electrophoretic display apparatus 100 according to an exemplary embodiment.

The electrophoretic display apparatus 100 includes a timing control unit 110, a gate driving unit 120, a source driving unit 130, a pixel unit 140, and a common voltage driving unit 150.

The timing control unit 110 receives an input image, a clock signal, a horizontal synchronization signal, and a vertical synchronization signal, and outputs a gate driving control signal to the gate driving unit 120, and a data signal and a source driving control signal to the source driving unit 130.

The gate driving unit 120 receives the gate driving control signal, a gate ON level voltage, and a gate OFF level voltage, and generates a gate signal. The gate driving unit 120 transmits the gate signal through gate lines G1-Gn to pixels PX.

The source driving unit 130 receives the data signal and the source driving control signal, and generates a source signal. The source driving unit 130 transmits the source signal through source lines S1-Sm to the pixels PX. According to exemplary embodiments, the source driving unit 130 may generate source signals that may be applied to pixel electrodes of the pixels PX, and selectively output a source signal to a pixel PX to which the gate signal having a gate pulse is applied. The output timing of the source signals will be described below in greater detail.

The pixel unit 140 includes the pixels PX. The pixels PX are arranged in an n*m matrix near the intersections at which the source lines S1-Sm cross with the gate lines G1-Gn. Each of the pixels PX is connected to one of the gate lines G1-Gn and one of the source lines S1-Sm. In one embodiment, the pixels PX may each include an electrophoretic cell Cep (see FIG. 2).

Figure 2:
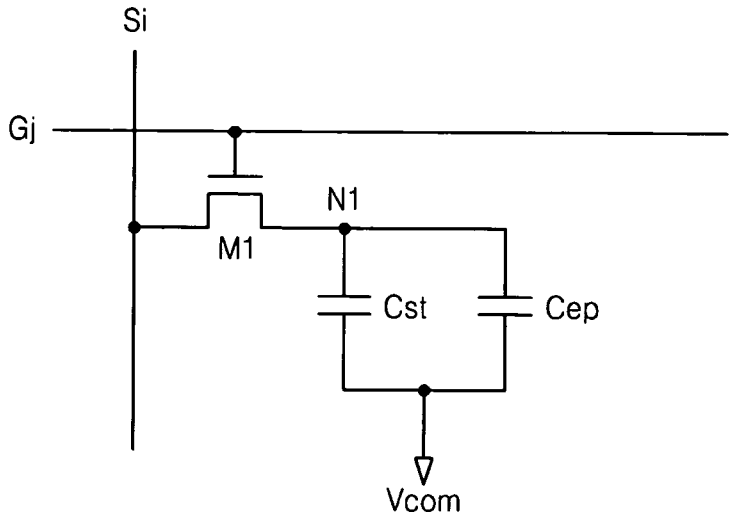
FIG. 2 is a circuit diagram illustrating a structure of one pixel according to an exemplary embodiment.

FIG. 2 is a circuit diagram illustrating a structure of one pixel PX according to an exemplary embodiment.

Referring to FIG. 2, the pixel PX may include a switching transistor M1, the electrophoretic cell Cep, and a storage capacitor Cst. The pixel PX may include the electrophoretic cell Cep between a pixel electrode and a common electrode. The switching transistor M1 includes a gate electrode connected to a gate line Gj, a first electrode connected to a source line Si, and a second electrode connected to a first node N1. The switching transistor M1 may be a thin-film transistor (TFT). The first node N1 is a node that is electrically equivalent to the pixel electrode. The electrophoretic cell Cep may be located between the pixel electrode connected to the first node N1, and a common electrode that transfers a common voltage Vcom.

The electrophoretic cell Cep may include a dispersion medium filling a space between the pixel electrode and the common electrode, and electrophoretic particles dispersed in the dispersion medium. The electrophoretic particles and the dispersion medium may be of different colors. The electrophoretic particles may be charged with positive or negative charges and move in the dispersion medium according to the polarity of a signal applied between the pixel electrode and the common electrode. The electrophoretic display apparatus 100 may display an input image by adjusting the level of the common voltage Vcom applied to the common electrode and the level of the source signal applied to the pixel electrode to cause the electrophoretic particles to move, changing the state of the electrophoretic cell Cep.

The storage capacitor Cst is connected between the first node N1 and the common electrode that transfers the common voltage Vcom.

When a gate pulse is input to the gate line Gj, the switching transistor M1 is turned on to allow the source signal input through the source line Si to be applied to the first node N1. Changes in voltage level of the first node N1 will be described below in detail.

The common voltage driving unit 150 generates a common voltage Vcom and provides the common voltage Vcom to the common electrode of the pixel PX. In one embodiment, the common voltage Vcom may be driven to have a different level for each timing period. The driving of the common voltage Vcom will be described below in greater detail.

Figure 3:
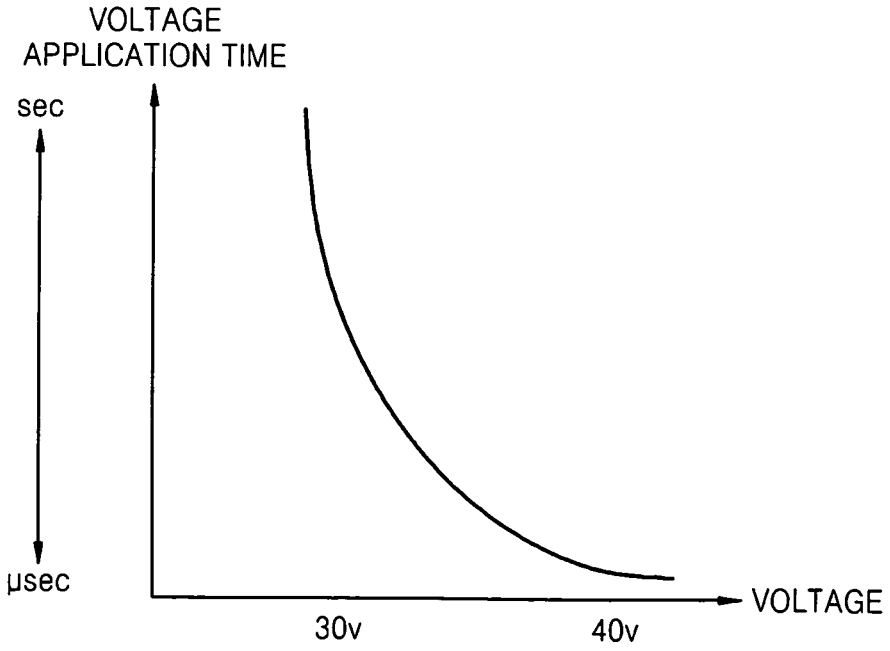
FIG. 3 is a graph illustrating a relationship between a level of a voltage applied to an electrophoretic cell and a voltage application time, according to an exemplary embodiment.

FIG. 3 is a graph illustrating a relationship between a level of a voltage applied to the electrophoretic cell Cep and a required voltage application time, according to an exemplary embodiment.

The electrophoretic display apparatus 100 may express a gradation as a function of the voltage level applied to the electrophoretic cell Cep and the voltage application time. The function may vary depending on the kind of a material that forms the dispersion medium of the electrophoretic cell Cep, and/or the kind and form of electrophoretic particles.

The electrophoretic cell Cep needs a predetermined voltage to be applied for a predetermined time to enable the electrophoretic particles to migrate and reach a desired state. The voltage application time for changing the state of the electrophoretic cell Cep has the relationship with the voltage level, as illustrated in FIG. 3. That is, the lower the voltage applied to the electrophoretic cell Cep, the longer the required voltage application time. The higher the voltage applied to the electrophoretic cell Cep, the shorter the required voltage application time.

When the electrophoretic particles in the electrophoretic cell Cep move fast at tens of msec or less, an active matrix driving unit that is incapable of controlling amplitude may be unable to achieve gradation display. For example, in an electrophoretic display apparatus operating at a frame frequency of 100 Hz, when a voltage is applied to the electrophoretic cell Cep, the voltage may be maintained in the pixel PX for 5 msec. A pulse width modulation (PWM) operation can be achieved at a response rate of electrophoretic particles of hundreds of mesc with a low voltage. However, in the electrophoretic display apparatus 100, which requires a reset operation, the reset operation may be perceived by a user, resulting in deteriorated quality. When a low response rate is applied to achieve gradation display, the display quality of the electrophoretic display apparatus 100 may be significantly degraded.

In some embodiments, to control a charge voltage level of the pixel (see FIG. 2) to allow a PAM operation in the electrophoretic display apparatus 100, a gate ON time Ton of the switching transistor M1 (see FIG. 2) of the pixel PX may be set at a given voltage to be shorter than the time it takes to fully charge the parasitic capacitance component of the switching transistor M1, or a voltage level of the source signal may be set for a given gate ON time Ton to be less than a voltage level required to fully charge the parasitic capacitance component of the switching transistor M1. The parasitic capacitance component of the switching transistor M1 may include at least one of a gate-source parasitic capacitance component, a gate parasitic capacitance component, and a gate-drain parasitic capacitance component, or a combination thereof. In the source driving unit 130 of the electrophoretic display apparatus 100 that outputs a few voltage level, a PAM operation may be performed using a source signal having a few voltage levels to enable gradation display by the electrophoretic display apparatus 100.

Figure 4:
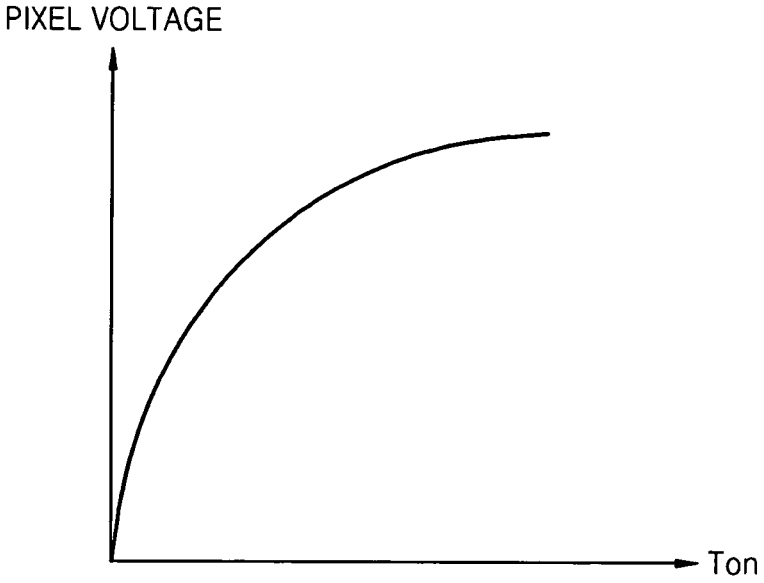
FIG. 4 is a graph illustrating pixel voltage of a pixel with respect to gate ON time Ton, according to an exemplary embodiment.

FIG. 4 is a graph illustrating pixel voltage of a pixel PX with respect to gate ON time Ton, according to an exemplary embodiment. As used therein, the terms "pixel voltage" refers to a voltage applied to the electrophoretic cell Cep.

Even when a constant pixel voltage is applied to the pixel electrode through the switching transistor M1, the storage capacitor Cst of the pixel PX may have a charged voltage that varies according to the gate ON time Ton, as illustrated in FIG. 4. In some embodiments, a gate ON time Ton of the switching transistor M1 (see FIG. 2) of the pixel may be set at a given voltage to be shorter than the time it takes to fully charge the parasitic capacitance component of the switching transistor M1, or a voltage level of the source signal may be set to be less than a voltage level required to fully charge the parasitic capacitance component of the switching transistor M1 for a given gate ON time Ton. Then a voltage level that is applied to the pixel electrode when the switching transistor M1 is turned on and the voltage application time for which a source signal having a gradation voltage level is applied to the pixel electrode are adjusted, thereby controlling the level of the charged voltage of the storage capacitor Cst.

Figure 5:
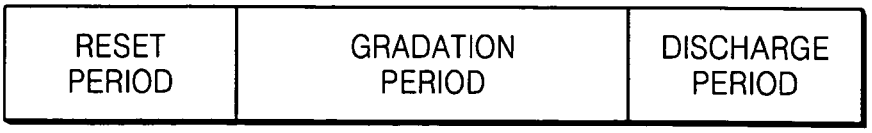
FIG. 5 illustrates a method of driving the electrophoretic display apparatus of FIG. 1, according to the exemplary embodiment.

FIG. 5 is a diagram illustrating a method of driving the electrophoretic display apparatus 100, according to an exemplary embodiment.

In one embodiment, the source driving unit 130 may output a source signal having limited voltage levels. The source signal may have three voltage levels, for example, a reset level, an intermediate level, and a gradation level. Descriptions of this specification will be provided with reference to source signals only with three voltage levels of −15V, 0V, and +15V. In some embodiments, gradation display using PAM may be achieved using a source signal with only three voltage levels and by adjusting a time for which the source signal with a gradation level is applied to a pixel electrode.

In one embodiment, the method of driving the electrophoretic display apparatus 100 may include a reset period, a gradation period, and a discharge period. The reset period is a period for which the state of the electrophoretic cell Cep is reset. The gradation period is a period of expressing a gradation at each pixel by adjusting the number of gate pulses of a source signal with the gradation level, and the voltage level of the storage capacitor Cst in each pixel PX. The discharge period is a period of discharging the charges from the storage capacitor Cst by applying a voltage level to both terminals of the storage capacitor Cst.

In one embodiment, gate pulses may be set to have a different pulse width for the reset period and the gradation period. In the reset period, a gate pulse with a pulse width of a first gate ON time Ton1 that is wide enough to allow the electrophoretic particles in the electrophoretic cell Cep to move to reach the reset state is applied. In the gradation period, a gate pulse with a pulse width of a second gate ON time Ton2 that is shorter than the time it takes to fully charge the parasitic capacitance component of the switching transistor M1 is applied to the gate electrode of the switching transistor M1, when the source signal with a gradation level is applied to the pixel PX. In the gradation period, a plurality of gate pulses may be applied. In the discharge period a gate pulse with a pulse width of a third gate ON time Ton3 that is wide enough to allow the charges stored in the storage capacitor Cst to be discharged is applied. The first gate ON time Ton1 and the third gate ON time Ton3 may be equal.

Figure 6:
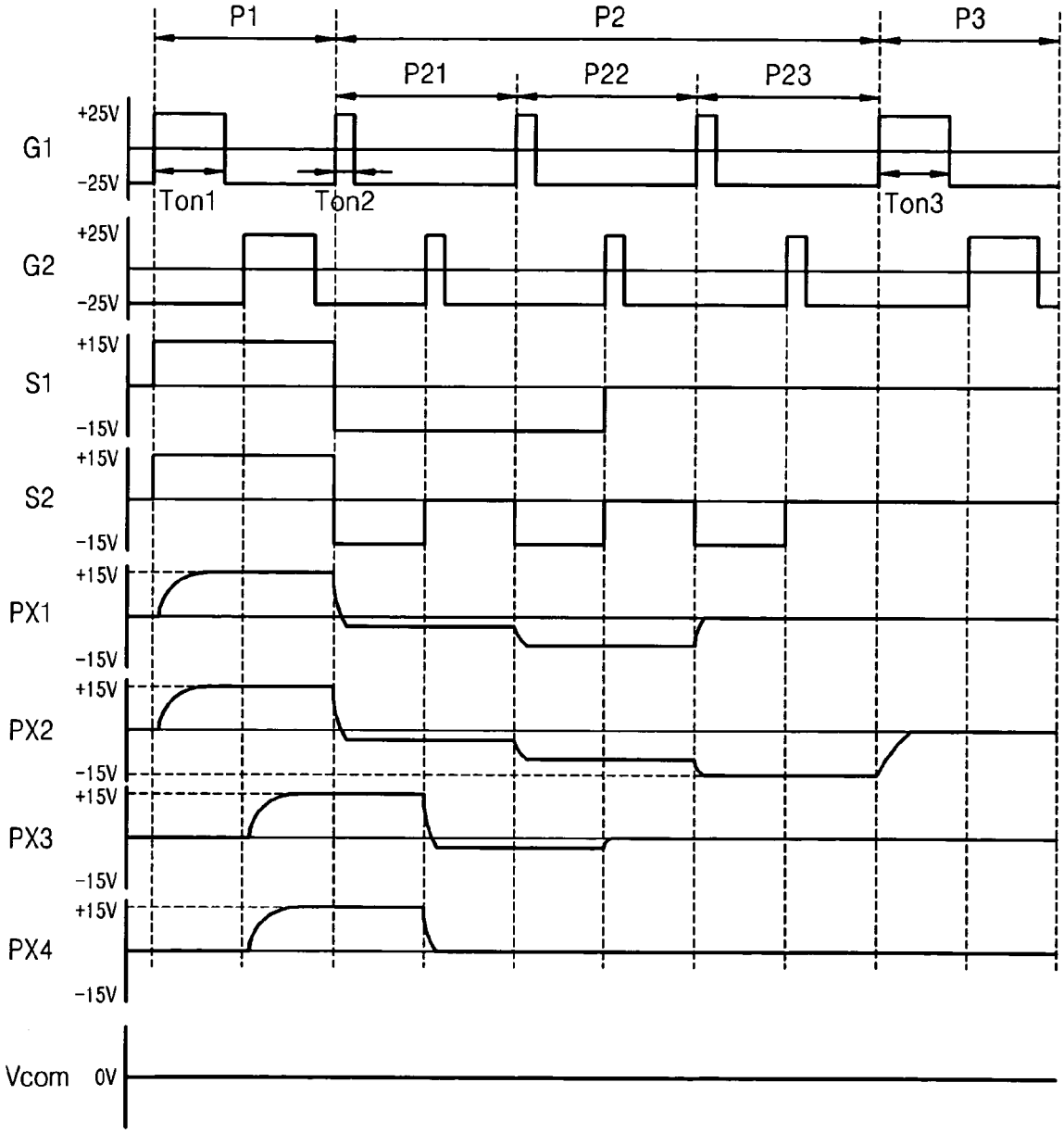
FIGS. 6 and 7 illustrate a driving method according to an exemplary embodiment.
Figure 7:
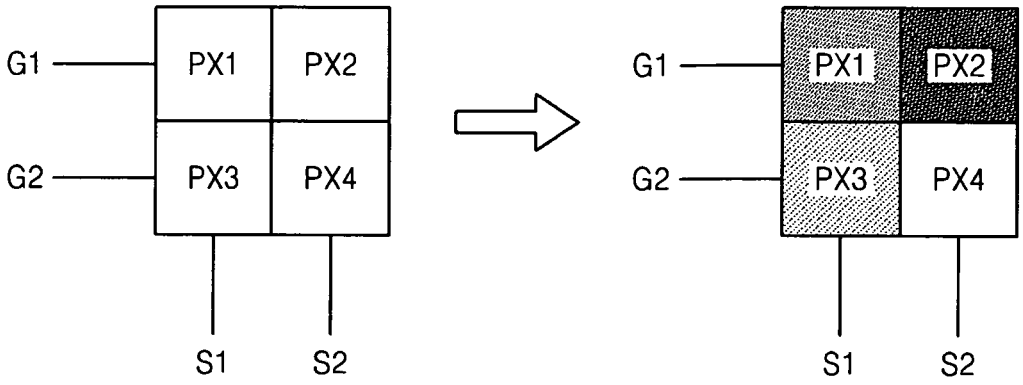

FIGS. 6 and 7 illustrate a driving method according to an exemplary embodiment. FIG. 6 is a timing diagram for driving first to fourth pixels PX1, PX2, PX3, and PX4 to have gradation values, as illustrated in FIG. 7.

Referring to FIG. 7, the second pixel PX2 has a black gradation, and the fourth pixel PX4 has a white gradation. The first and third pixels PX1 and PX3 have intermediate gradations, but the third pixel PX3 has a higher gradation than the first pixel PX1. The first pixel PX1 and the second pixel PX2 are connected to the first gate line G1, and the third pixel PX3 and the fourth pixel PX4 are connected to the second gate line G2. The first pixel PX1 and the third pixel PX3 are connected to the first source line S1, and the second pixel PX2 and the fourth pixel PX4 are connected to the second source line S2.

Referring to FIG. 6, G1 and G2 denote gate signal levels of the first gate line G1 and the second gate line G2, respectively. S1 and S2 denote source signal levels of the first source line S1 and the second source line S2, respectively. PX1, PX2, PX3, and PX4 denote voltages applied to the electrophoretic cell Cep. Vcom denotes the level of the common voltage.

According to the current embodiment, the driving method includes a reset period P1, a gradation period P2, and a discharge period P3. The reset period P1, the gradation period P2, and the discharge period P3 are repeated while an input image is displayed on the electrophoretic display apparatus 100.

A source signal may have a reset level, a gradation level, and an intermediate level. The reset level is a voltage level applied to reset the state of the electrophoretic cell Cep. The gradation level is a voltage level applied to change the state of the electrophoretic cell Cep for a gradation period P2. The reset level and the gradation level may have opposite polarities. The intermediate level is a voltage level between the reset level and the gradation level. The current embodiment is described with a reset level of +15V, an intermediate level of 0V, and a gradation level of −15V. However, the reset level, the intermediate level, and the gradation level may vary according to embodiments.

In the reset period P1, a first gate signal that is applied to the first gate line G1 and a second gate signal that is applied to the second gate line G2 may each have one gate pulse. In an embodiment, as shown in FIG. 6, a gate pulse is sequentially applied to the first gate line G1 and then to the second gate line G2 in the reset period P1. The gate pulse applied for the reset period P1 may have a pulse width corresponding to the first gate ON time Ton1. In the reset period P1, a first source signal applied to the first source line S1 and a second source signal applied to the second source line S2 have a reset level of +15V. During the first gate ON time Ton1, the first source signal of the reset level of +15V is applied to the first pixel PX1 and the third pixel PX3, and the second source signal of the reset level of +15V is applied to the second pixel PX2 and the fourth pixel PX4, to reset the state of the electrophoretic cells Cep of the first to fourth pixels PX1, PX2, PX3, and PX4. Accordingly, the electrophoretic cells Cep of the first to fourth pixels PX1, PX2, PX3, and PX4 are reset with the reset voltage of +15V. In the reset period P1, the gate pulse with a width of the first gate ON time Ton1 ensures the parasitic capacitance component of the switching transistor M1 to be fully or substantially fully charged, allowing to apply a source signal of the reset level to the pixel electrodes of the first to fourth pixels PX1, PX2, PX3, and PX4.

According to one embodiment, the gradation period P2 may include a first sub-gradation period P21, a second sub-gradation period P22, and a third sub-gradation period P23. The gradation period P2 may include any number of sub-gradation periods according to embodiments.

In the first, second, and third sub-gradation periods P21, P22, and P23, the first and second source signals may have a gradation level of −15V or an intermediate level of 0V. According to one embodiment, the intermediate level (0V) of voltage may be equal to the level of the common voltage Vcom. The number of sub-gradation periods for which a source signal having a gradation level of −15V is to be applied for the gradation period P2 is determined according to a desired gradation of each of the pixels. In the embodiment of FIG. 6, the first to fourth pixels PX1, PX2, PX3, and PX4 may be reset with a white gradation in the reset period P1. The lower the charged voltage of the pixels, the lower the gradation expressed. The greater the number of sub-gradation periods for which a source signal having a gradation level of −15V is applied, the lower the gradation expressed, and vice versa. In the embodiment of FIGS. 6 and 7, a source signal having a gradation level of −15V is applied to the second pixel PX2, which has the lowest black gradation, for three sub-gradation periods, namely, the first, second, and third sub-gradation periods P21, P22, and P23. A source signal having a gradation level of −15V is applied to the first pixel PX1, which has the second lowest gradation after the second pixel PX2, for two sub-gradation periods, namely, the first and second sub-gradations periods P21 and P22. A source signal having a gradation level of −15V is applied to the third pixel PX3, which has the next low gradation after the first pixel PX1, for one sub-gradation period P21. However, for the fourth pixel PX4, a source voltage having a gradation level of −15V is not applied, and instead, a source signal having an intermediate level of 0V is applied to the fourth pixel PX4 for the first, second, and third sub gradation periods P21, P22, and P23. The gradation of each of the pixels, namely, the first to fourth pixels PX1, PX2, PX3, and PX4 is determined according to the number of sub-gradation periods for which the gradation level (−15V) of voltage is applied. The first source signal S1 and the second source signal S2 may be driven such that the number of sub-gradation periods corresponds to the gradation of an input image. However, the method of driving the first source signal S1 and the second source signal S2 is not limited to the embodiment of FIG. 6 and other methods may be used.

A driving operation for the gradation period P2 in the embodiment of FIG. 6 will be described in greater detail. In the gradation period P2, a gate pulse with a pulse width of a second gate ON time Ton2 is sequentially applied to the first gate line G1 and then to the second gate line G2 for each of the first, second, and third sub-gradation periods P21, P22, and P23. When a gate pulse is applied to the first gate line G1, a first source signal having a voltage level that corresponds to the gradation of the first pixel PX1 is applied to the first source line S1, and a second source signal having a voltage level that corresponds to the gradation of the second pixel PX2 is applied to the second source line S2. When a gate pulse is applied to the second gate line G2, a first source signal having a voltage level that corresponds to the gradation of the third pixel PX3 is applied to the first source line S1, and a second source signal having a voltage level that corresponds to the gradation of the fourth pixel PX4 is applied to the second source line S2.

In one embodiment, the second gate ON time Ton2 may be set to be shorter at a given voltage level of the gate pulse than the time it takes to charge the parasitic capacitance component of the switching transistor M1. Due to this construction, even when a source signal having a gradation level of −15V is applied to a pixel PX after the gate pulse is applied, the voltage level of the corresponding pixel electrode may not instantly vary to the gradation level (−15V) of the source signal within one sub-gradation period and may vary less to not reach the gradation level (−15V). Therefore, the voltage level of the pixel electrode of each pixel may be controlled by varying the number of sub-gradation periods for which a source signal having a gradation level of −15V is applied. Therefore, gradation display by PAM may be achieved using a source signal having a few voltage levels. In the embodiment of FIG. 6, the voltage of each of the first to fourth pixels PX1, PX2, PX3, and PX4 may drop only by about 5V for each sub-gradation period of the gradation period P2, even when the source signal having a gradation level of −15V is applied to the corresponding pixel while a gate pulse is applied thereto.

When the pixel voltage of a pixel reaches a level corresponding to the gradation of the input image in the pixel display period P2, the pixel voltage may be reset to 0V. The electrophoretic cell Cep may be maintained in a specific state in a zero-voltage condition. Accordingly, a zero voltage may be applied to maintain the electrophoretic cell Cep in a specific state. Once the pixel voltage has reached the level corresponding to the gradation of the input image, up to a next frame may be displayed in gradation, even when the pixel voltage is changed to 0V.

In the discharge period P3, while a gate pulse is applied to the first to fourth pixels PX1, PX2, PX3, and PX4, a source signal having an intermediate level of 0V is applied thereto. Accordingly, all the pixel voltages may reach 0V in the discharge period P3, so that charges in the storage capacitor Cst of each pixel are fully discharged. In the discharge period P3, a gate pulse with a pulse width of a third gate ON time Ton3 that is wide enough to allow to fully charge the parasitic capacitance component of the switching transistor M1 and to fully discharge the storage capacitor Cst is sequentially applied to the first and second gate lines G1 and G2. Accordingly, the storage capacitors Cst of all the pixels PX are discharged whenever each frame ends.

Changes in pixel voltage for one sub-gradation period may depend on the characteristics of the electrophoretic cell Cep and the switching transistor M1. In general, a rate of discharge operation is faster than a rate of charging operation with respect to the storage capacitor Cst. Accordingly, the pixel voltage may much rapidly respond to the discharge operation. In the driving method of FIG. 6, which is an exemplary embodiment, the voltage level of each signal and the reset scheme are not limited thereto. That is, the voltage levels of the gate pulses, the voltage levels of and the number of voltage levels of the source signal, the response rates of the pixel voltages, and the level of the common voltage Vcom may vary. According to the embodiment of FIG. 6, a source signal having a reset level of +15V may be applied for the reset period P1, and a source signal having an intermediate level of 0V or a gradation level of −15V may be applied to each pixel PX for the gradation period P2. However, aspects of the present invention are not limited thereto. For example, a source signal having a reset level of −15V may be applied to each pixel PX for the reset period P1, and a source signal having an intermediate level of 0V or a reset level of −15V may be applied to each pixel PX for the gradation period P3.

Figure 8:
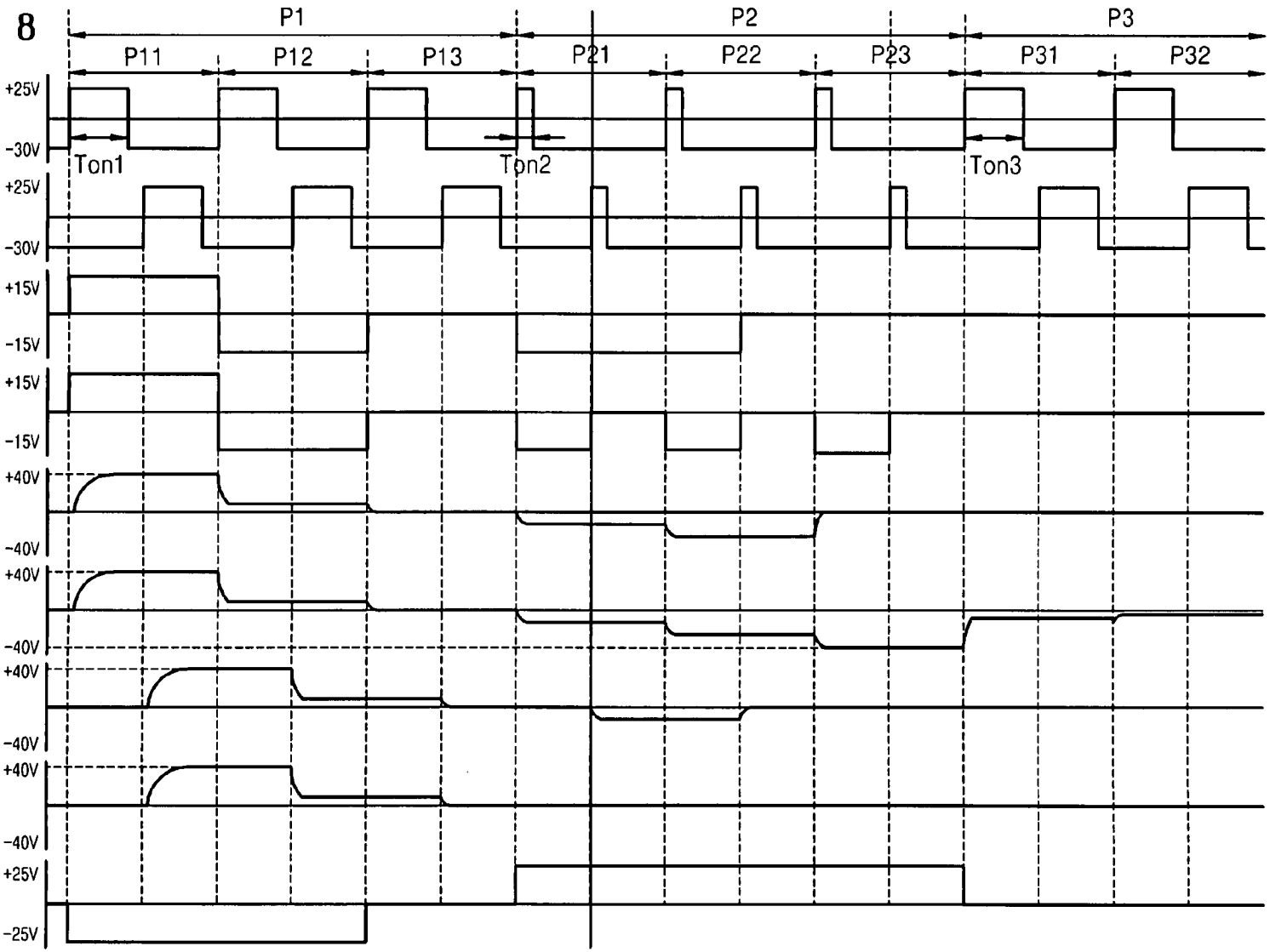
FIG. 8 is a timing diagram illustrating a method of driving an electrophoretic display apparatus, according to another exemplary embodiment.

FIG. 8 is a timing diagram illustrating a method of driving an electrophoretic display apparatus, according to another exemplary embodiment.

In the current embodiment, the common voltage Vcom is inverted when the reset period P1 moves onto the gradation period P2. Accordingly, the driving operation may be performed with a wider range of pixel voltages. In the embodiment of FIG. 8, with a common voltage Vcom ranging from −25V to +25V, the source signal may have a level from −15V to +15V and the pixel voltage may have a level from −40V to +40V. The embodiment in FIG. 8 is for driving the first to fourth pixels PX1, PX2, PX3, and PX4 to have the gradation values illustrated in FIG. 7.

The common voltage Vcom may have a first level, a common voltage intermediate level, and a second level. The first level is a level of opposite polarity to the reset level of the source signal. The second level is a level of opposite polarity to the gradation level of the source signal. The intermediate level, which is a voltage level between the first and second levels, may be a level equal to the intermediate level of the source signal. The current embodiment is described with a first level of −25V, a common voltage intermediate level of 0V, and a second level of +25V. However, the first level, the common voltage intermediate level, and the second level of the common voltage Vcom may vary according to embodiments.

In one embodiment, the reset period P1 may include first to third sub-reset periods P11, P12, and P13. The common voltage Vcom may have a first level of −25V for the first sub-reset period P11 and the second sub-reset period P12, and a common voltage intermediate level of 0V for the third sub-reset period P13.

In the first to third sub-reset periods P11, P12, and P13, the first to fourth pixels PX1, PX2, PX3, and PX4 are charged to a maximum positive level, which then gradually falls to 0V, resetting the first to fourth pixels PX1, PX2, PX3, and PX4. For the first to third sub-reset periods P11, P12, and P13, a gate pulse with a pulse width of a first gate ON time Ton1 is sequentially applied to the first gate line G1 and then to the second gate line G2.

In particular, a source signal having a reset level of +15V is applied to each of the first to fourth pixels PX1, PX2, PX3, and PX4 for the first sub-reset period P11, allowing the first to fourth pixels PX1, PX2, PX3, and PX4 to be charged with a maximum positive pixel voltage of +40V. Since the gate pulse with a pulse width of the first gate ON time Ton1 is applied to each of the first to fourth pixels PX1, PX2, PX3, and PX4 for the first to third sub-reset periods P11, P12, and P13, the pixel electrode may have a voltage level corresponding to the reset level of +15V of the source signal, and the common electrode may have a voltage level corresponding to the first level of −25V. Therefore, the first to fourth pixels PX1, PX2, PX3, and PX4 may be charged with a maximum positive voltage of +40V.

In the second sub-reset period P12, a source signal having a gradation level of −15V is applied to each of the first to fourth pixels PX1, PX2, PX3, and PX4, falling the maximum positive pixel voltage (+40V) of each of the first to fourth pixels PX1, PX2, PX3, and PX4 to a predetermined level. When the first to fourth pixels PX1, PX2, PX3, and PX4 receive the source signal having the gradation level of −15V, charges stored in the storage capacitor Cst of each pixel are discharged to a predetermined level.

In the third sub-reset period P13, the common voltage Vcom may change to have a common voltage intermediate level of 0V, and the source signal may change to have an intermediate level of 0V. As a result, the pixel voltage of each of the first to fourth pixels PX1, PX2, PX3, and PX4 may become 0V, resulting in the storage capacitor Cst fully discharged, and the electrophoretic cell Cep of 0V. Thus, the electrophoretic cells Cep of the first to fourth pixels PX1, PX2, PX3, and PX4 are reset to the same state. When the common voltage Vcom is inverted from a first level of −25V to a second level of +25V, instantaneously a gate-source high voltage of the switching transistor M1 may become high. This may cause a leakage current from the switching transistor M1, even without an application of a gate pulse to the switching transistor M1. In one embodiment, to prevent such leakage current, the common voltage Vcom may be controlled to have a common voltage intermediate level of 0V for the third sub-reset period P13 and have a second level of +25V in the following gradation period P2.

When the gradation period P2 begins, the common voltage Vcom is inverted to a second level of +25V. The gradation period P2 may include a plurality of sub-gradation periods. The source signal may have an intermediate level of 0V or a gradation level of −15V. In the embodiment of FIG. 8, the gradation period P2 may include first, second, and third sub-gradation periods P21, P22, and P23. The gradation values of the first to fourth pixels PX1, PX2, PX3, and PX4 may be determined according to the number of sub-gradation periods for which the source signal having a gradation level of −15V is applied to each pixel, as in the embodiment of FIG. 6. In the current embodiment, the common voltage Vcom is inverted to have a second level of +25V for the gradation period P2, which allows to control the pixel voltage of each of the first to fourth pixels PX1, PX2, PX3, and PX4 within a wider range. In the embodiment of FIG. 8, the pixel voltage may have a level of from +40V to −40V. To fully discharge the storage capacitor Cst for one sub-gradation period after the pixel voltage reaches a target voltage that corresponds to the gradation of the input image in the gradation period P2, the voltage level of the source signal, the voltage level of the common voltage Vcom, or the pulse width of the gate signal in the third gradation period P23 may be adjusted. For example, the gate signal that is applied for the last sub-gradation period P23 of the plurality of sub-gradation periods P21, and P22, and P23, which forms the gradation period P2, may be set to have a greater width than those of the other sub-gradation periods P21 and P22, allowing each of the first to fourth pixels PX1, PX2, PX3, and PX4 to be fully discharged to a pixel voltage of 0V or to be fully charged with a minimum voltage level of −40V for the last sub-gradation period P23.

In the discharge period P3, a gate pulse having a width corresponding to the third gate ON time Ton3 to discharge the charges stored in the storage capacitor Cst of each of the first to fourth pixels PX1, PX2, PX3, and PX4 may be applied. In the embodiment of FIG. 8, the discharge period P3 may include a first sub-discharge period P31 and a second sub-discharge period P32.

In the first sub-discharge period P31 and the second sub-discharge period P32, the common voltage Vcom may have a common voltage intermediate level of 0V, and the first and second source signals may have an intermediate level of 0V. This may allow the storage capacitor Cst of each of the first to fourth pixels PX1, PX2, PX3, and PX4 to be fully discharged. In another embodiment, only one gate pulse may be applied for the discharge period P3, as in the embodiment of FIG. 6.

Figure 9:
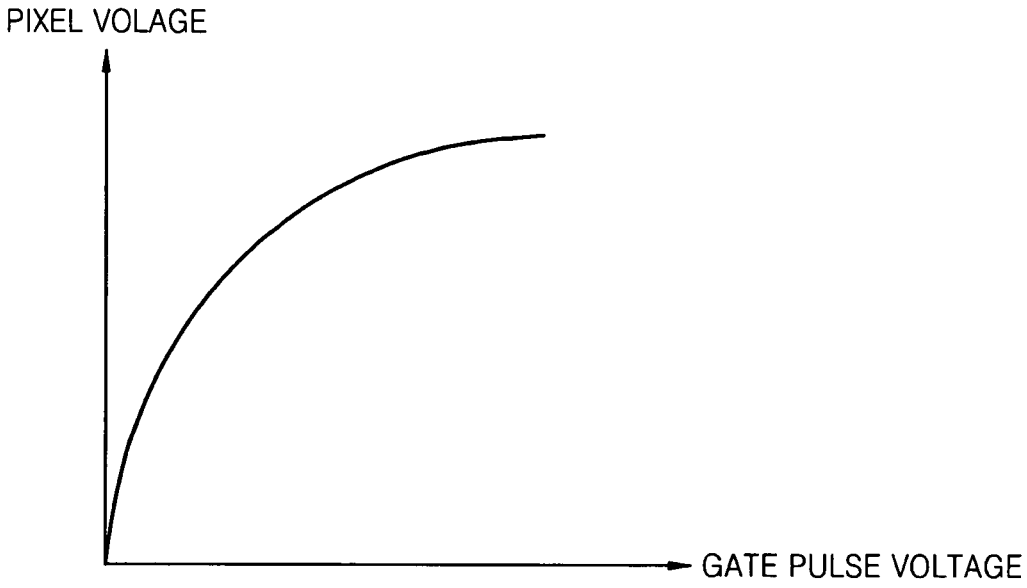
FIG. 9 is a graph illustrating a pixel voltage with respect to a gate pulse voltage.

FIG. 9 is a graph illustrating a relationship between a pixel voltage and a gate pulse voltage.

A charged voltage of the storage capacitor Cst in each pixel PX may vary according to the voltage level of a gate pulse applied to the switching transistor M1. Under the assumption that gate pulses with different levels are applied to the switching transistor M1 for a given gate ON time Ton, as shown in FIG. 9, the greater the voltage level of the gate pulse, the greater the charged voltage of the storage capacitor Cst.

Based on this characteristic, the pixel voltage of each pixel PX may be controlled in another embodiment. In one embodiment, a gate pulse applied for the gradation period P2 may be set to have a lower voltage level than those applied for the reset period P1 and the discharge period P3, and the number of sub-gradation periods for which a source signal having a gradation level is applied may be appropriately adjusted to control a display gradation of each pixel PX. The voltage level of a gate pulse applied for the gradation period P2 with a predetermined pulse width may be set to a level that is insufficient to fully charge the parasitic capacitance component of the switching transistor M1 during the application of the gate pulse. Therefore, as in the previous embodiments described with reference to FIGS. 6-8, a gradation of each pixel PX may be expressed according to the number of sub-gradation periods for which a source signal having a gradation level is applied.

Figure 10:
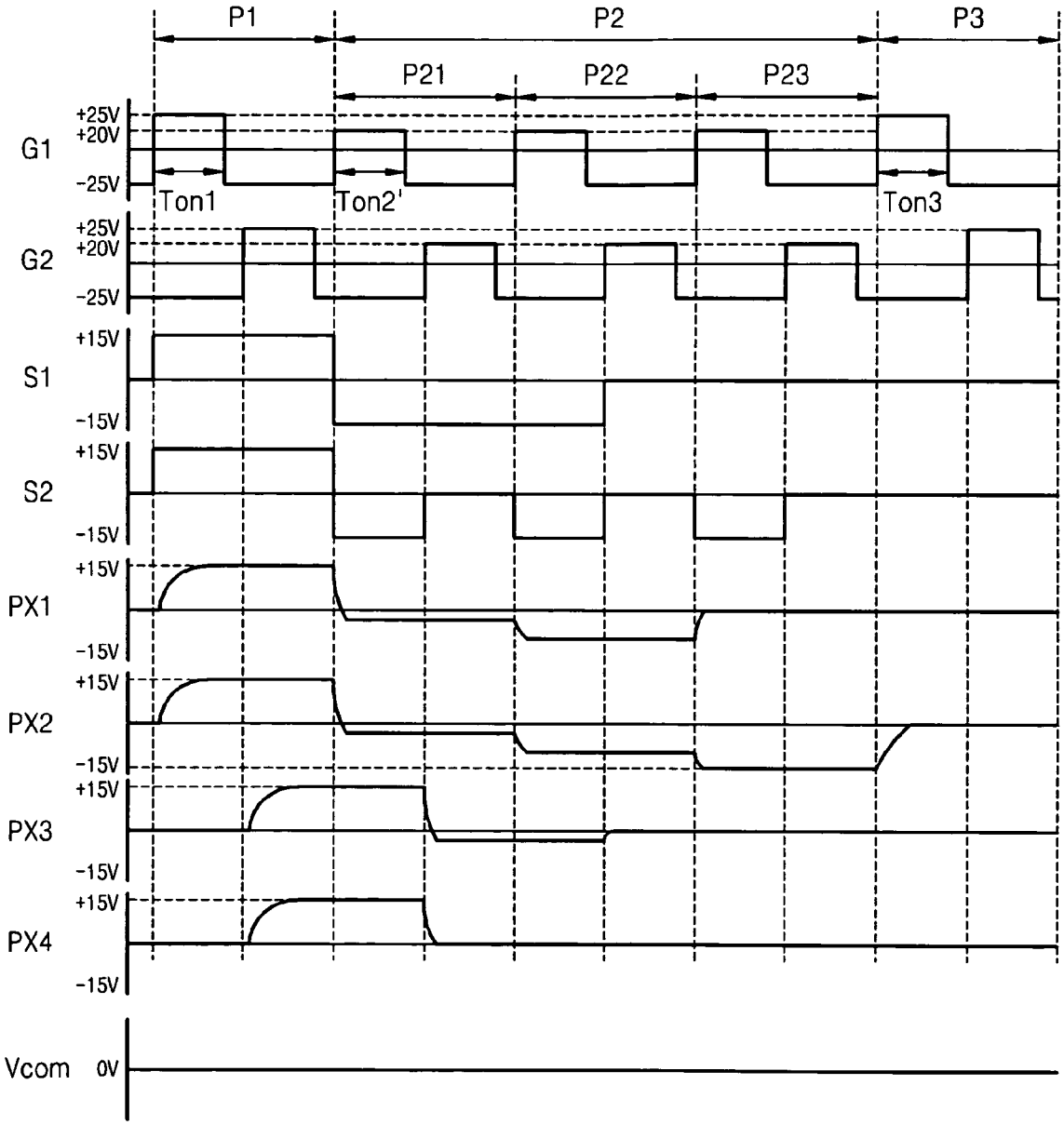
FIG. 10 is a timing diagram illustrating a driving method according to another embodiment.

FIG. 10 is a timing diagram illustrating a driving method according to another embodiment. The timing diagram of FIG. 10 is for driving the first to fourth pixels PX1, PX2, PX3, and PX4 to have the gradation values in FIG. 7.

According to the current embodiment, the method of driving the electrophoretic display apparatus 100 may include a reset period P1, a gradation period P2, and a discharge period P3.

In the reset period P1, the electrophoretic cell Cep of each pixel PX is reset as described above.

In the gradation period P2, the number of sub-gradation periods for which a source signal having a gradation level of −15V is applied may be controlled to express a gradation at each pixel PX. A second gate ON time Ton2', which corresponds to the pulse width of a gate pulse applied for the gradation period P2, may be equal to the first gate ON time Ton1 and the third gate ON time Ton3. In the current embodiment, the voltage level of a gate pulse applied for the gradation period P2 may be set to a level that is lower than those of the gate pulses applied for the reset period P1 and the discharge period P3 and is insufficient to fully charge the parasitic capacitance component of the switching transistor M1 for the second gate ON time Ton2'.

As described above, in the discharge period P3, the storage capacitor Cst of each pixel is discharged, allowing the electrophoretic cell Cep to have a voltage of 0V.

Figure 11:
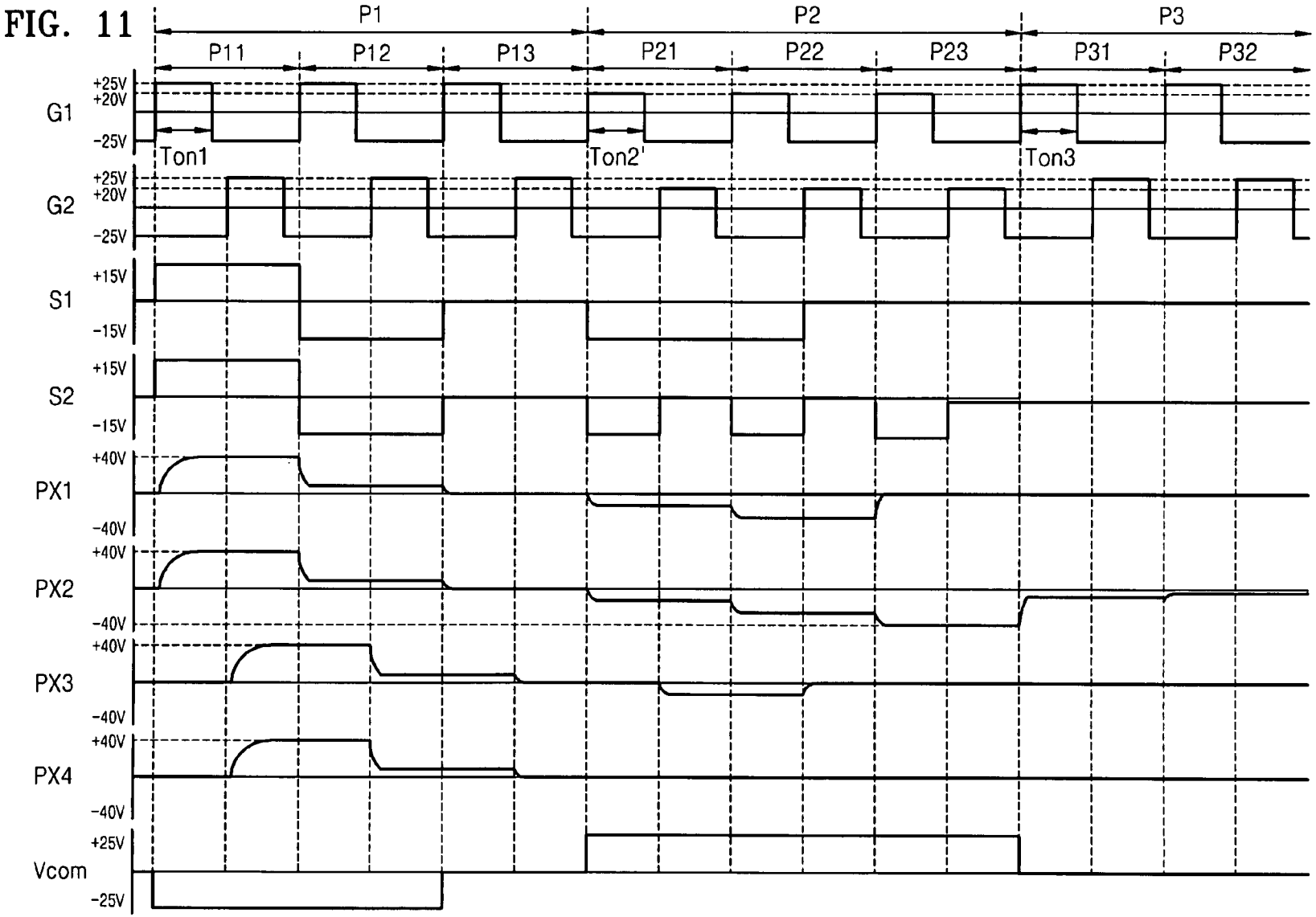
FIG. 11 is a timing diagram illustrating a driving method according to another embodiment.

FIG. 11 is a timing diagram illustrating a driving method according to another embodiment. The timing diagram of FIG. 11 is for driving the first to fourth pixels PX1, PX2, PX3, and PX4 to have the gradation values in FIG. 7.

In the current embodiment, as in the previous embodiments, the voltage level of a gate pulse applied for the gradation period P2 may be set to be lower than those of the gate pulses applied for the reset period P1 and the discharge period P3, and the common voltage Vcom may be inverted according to the period. The voltage level of the gate pulse applied for the gradation period P2 may be set to a level that is insufficient to fully charge the parasitic capacitance component of the switching transistor M1 during the second gate ON time Ton2', as in the embodiment of FIG. 10. As in the embodiment of FIG. 8, when the reset period P1 moves to the gradation period P2, the common voltage Vcom may be inverted. When the gradation period P2 moves onto the discharge period P3, the common voltage Vcom may be changed to a common voltage intermediate level of 0V. A greater pixel voltage may be attained using a source signal having limited voltage levels.

According to the one or more embodiments described above, an electrophoretic display apparatus may be operated using PAM to express gradations. In the electrophoretic display apparatus and the method for controlling the electrophoretic display apparatus, PAM driving may be performed using a driving unit that outputs a source signal having limited levels.

Exemplary embodiments have been disclosed herein, and although specific terms are employed, they are used and are to be interpreted in a generic and descriptive sense only and not for purpose of limitation.

What is claimed is:

1. A method of driving an electrophoretic display apparatus, the method comprising:

applying at least one gate pulse of a second pulse width to each of a plurality of pixels during a reset period, the at least one gate pulse to reset a state of an electrophoretic cell of each of the pixels;

applying gate pulses to the plurality of pixels in a gradation period after the reset period, each of the gate pulses in the gradation period having a first pulse width and a first voltage level, being a gate ON voltage level, that are set not to fully charge a parasitic capacitance component of a switching transistor of a corresponding pixel of the plurality of pixels, the second pulse width greater than the first pulse width; and during the gradation period, applying source signals to the plurality of pixels, respectively, when the gate pulses are applied, each of the source signals having a gradation level or an intermediate level in the gradation period, the gradation level being different from the intermediate level, wherein:

the gradation period has a varying number of sub-gradation periods, and a gradation level of each pixel is controlled according to the number of sub-gradation periods for a pixel and a pixel voltage of the pixel.

2. The method of claim 1, wherein:

the at least one gate pulse applied during the reset period has a second voltage level that is sufficient to charge the parasitic capacitance component of the switching transistor of a corresponding pixel;

the second pulse width of the at least one gate pulse applied during the reset period is set to at least substantially fully charge the parasitic capacitance component of the switching transistor of a corresponding pixel of the plurality of pixels; and the method further includes applying source signals to the plurality of pixels during the reset period, respectively, when the gate pulses are applied, each source signal having a reset level, the reset level being different from the gradation level and different from the intermediate level.

3. The method of claim 2, wherein, for the gate pulses, the first voltage level for the gradation period is lower than the second voltage level for the reset period.

4. The method of claim 2, further comprising providing a discharge period of discharging the plurality of pixels after the gradation period.

5. The method of claim 2, further comprising:

applying, to the plurality of pixels, a common voltage having a level that is constant during the gradation and reset periods.

6. The method of claim 2, further comprising applying a common voltage to the plurality of pixels, wherein the applying of the common voltage includes:

during the reset period, applying a first common voltage level of a same polarity as the gradation voltage; and during the gradation period, applying a second common voltage level of a different polarity from a gradation voltage applied.

7. The method of claim 6, further comprising providing a discharge period of discharging the plurality of pixels after the gradation period, wherein the applying of the common voltage further includes applying the common voltage having a same level as the source signals for the discharge period.

8. A method for driving an electrophoretic display apparatus, the method comprising:

providing a reset period for resetting a state of electrophoretic cells of a plurality of pixels; and providing a gradation period in which:

gate pulses are applied to a plurality of pixels, each of the gate pulses in the gradation period having a first pulse width and a first voltage level, being a gate ON voltage level, that are set not to fully charge a parasitic capacitance component of a switching transistor of a corresponding pixel of the plurality of pixels, and source signals are applied to the plurality of pixels, when the gate pulses are applied, each of the source signals having a gradation level or an intermediate level in the gradation period, the gradation level being different from the intermediate level, wherein the gradation period has a varying number of sub-gradation periods, and a gradation level of each pixel is controlled according to the number of sub-gradation periods for a pixel and a pixel voltage of the pixel, wherein the reset period includes a first sub-reset period, a second sub-reset period, and a third sub-reset period for which the gate pulses are applied, wherein, among the source signals, a source signal having a reset level and a common voltage having a third common voltage level of an opposite polarity to the reset level is applied to each of the plurality of pixels for the first sub-reset period, the source signal having the gradation level and the common voltage having the third common voltage level are applied to each of the plurality of pixels for the second sub-reset period, and wherein the common voltage has a same level as the source signals applied to each of the plurality of pixels for the third sub-reset period.

9. An electrophoretic display apparatus, the apparatus comprising:

a plurality of pixels each having an electrophoretic cell;

a gate driving unit; and a source driving unit, wherein:

the gate driving unit outputs at least one gate pulse of a second pulse width to each of the pixels during a reset period, the at least one gate pulse to reset a state of an electrophoretic cell of each of the pixels, and outputs gate pulses to the plurality of pixels, respectively, during a gradation period after the reset period, each of the gate pulses in the gradation period having a first pulse width and a first voltage level, being a gate ON voltage level, that are set not to fully charge a parasitic capacitance component of a switching transistor of a corresponding pixel of the plurality of pixels, the second pulse width greater than the first pulse width; and the source driving unit outputs source signals to the plurality of pixels, respectively, when the gate pulses are applied during the gradation period, each of the source signals having a gradation level or an intermediate level, the gradation level being different from the intermediate level, the gradation period has a varying number of sub-gradation periods, and a gradation of each pixel is controlled according to the number of sub-gradation periods for the pixel and a pixel voltage level of the pixel.

10. The electrophoretic display apparatus of claim 9, wherein:

the at least one gate pulse output during the reset period has a second voltage level that is set to be sufficient to charge the parasitic capacitance component of the switching transistor of the corresponding pixel, the second pulse width of the at least one gate pulse applied during the reset period is set to at least substantially fully charge the parasitic capacitance component of the switching transistor of a corresponding pixel of the plurality of pixels, and the source driving unit applies source signals to the plurality of pixels, respectively, for the reset period when the gate pulses are applied, each source signal having a reset level, the reset level being different from the gradation level and different from the intermediate level.

11. The electrophoretic display apparatus of claim 10, wherein, for the gate pulses, the first voltage level for the gradation period is lower than the second voltage level for the reset period.

12. The electrophoretic display apparatus of claim 10, wherein the gate driving unit and the source driving unit operate for a discharge period after the gradation period, wherein the plurality of pixels is discharged for the discharge period.

13. The electrophoretic display apparatus of claim 10, further comprising a common voltage driving unit that generates a common voltage having a constant level to apply the common voltage to the plurality of pixels, the constant level being constant during the gradation and reset periods.

14. The electrophoretic display apparatus of claim 10, further comprising a common voltage driving unit that generates a common voltage to apply the common voltage to the plurality of pixels, the common voltage including a first common voltage level having a same polarity as the gradation level and applied to the plurality of pixels during the reset period, and a second common voltage level having an opposite polarity to the gradation level and applied to the plurality of pixels during the gradation period.

15. The electrophoretic display apparatus of claim 14, wherein the gate driving unit, the source driving unit, and the common voltage driving unit operate for a discharge period after the gradation period, wherein the plurality of pixels is discharged for the discharge period, and the common voltage driving unit applies the common voltage having a same level as the source signals to the plurality of pixels for the discharge period.

16. The electrophoretic display apparatus of claim 9, wherein the reset period comprises a first sub-reset period, a second sub-reset period, and a third sub-reset period for which the gate pulses are applied, wherein, among the source signals, the source driving unit applies a source signal having a reset level to the plurality of pixels for the first sub-reset period, a source signal having the gradation level to the plurality of pixels for the second sub-reset period, and a source signal having the intermediate level to the plurality of pixels for the third sub-reset period, a common voltage driving unit applies a common voltage having a third common voltage level of an opposite polarity to the reset level to the plurality of pixels for the first sub-reset period and the second sub-reset period, and the common voltage having a same level as the source signal to the plurality of pixels for the third sub-reset period.

* * * * *